United States Patent [19]

Donofrio

[11] 4,096,904

[45] Jun. 27, 1978

[54] ROLLER SHADE BRAKING MECHANISM

[75] Inventor: John D. Donofrio, Ogdensburg, N.Y.

[73] Assignee: Joanna Western Mills Company, Chicago, Ill.

[21] Appl. No.: 828,949

[22] Filed: Aug. 29, 1977

[51] Int. Cl.[2] ..... E06B 9/208

[52] U.S. Cl. ..... 160/299; 188/83; 188/343; 160/326

[58] Field of Search ..... 160/291–292, 160/298, 325, 299, 323, 326; 188/83, 343

[56] References Cited

U.S. PATENT DOCUMENTS

| | | | |
|---|---|---|---|
| Re. 6925 | 2/1876 | Knapp | 160/299 |
| 187,868 | 2/1877 | Knapp | 160/299 |
| 2,828,429 | 3/1958 | Creonti | 160/298 X |
| 3,211,212 | 10/1965 | Smith | 160/298 |

*Primary Examiner*—Kenneth Downey

[57] ABSTRACT

A roller shade braking mechanism of the type including a pair of outwardly biased braking shoes for engaging a cylindrical brake drum. The brake shoes are urged into braking engagement by an axially positionable wedge which cams against the interior surfaces of the brake shoes to thereby produce a constantly applied braking force. Externally accessible adjustment means are also provided for adjusting the pressure exerted by said brake shoes.

9 Claims, 4 Drawing Figures

ROLLER SHADE BRAKING MECHANISM

BACKGROUND OF THE INVENTION

1. Field of the Invention

The present invention relates to braking mechanisms for roller type shades, particularly those of considerable width where the shade material may be of substantial weights. More specifically, the invention relates to an externally adjustable braking mechanism which may be adjusted to provide a selected degree of resistance to the winding and unwinding movement of the roller shade.

2. Discussion of the Prior Art

As is well known, most commercially available roller shades are equipped with a spring driven return mechanism and an intermittantly operable ratchet mechanism for holding the shade against the rewinding force in a desired unwound and extended position. As is also well known, these prior art ratchet devices are subject to intermittant failures resulting in the startling, undesired and abrupt uncontrollable rewinding of the shade. In order to avoid this undesirable behavior, various arrangements of roller shade braking mechanisms have been developed and are known in the prior art.

Such arrangements are exemplified, for example, in prior U.S. Pat. Nos. 1,699,555; 1,268,914; 2,678,094; 2,166,745; 1,772,700; 1,275,168; and 3,211,212. Of these patents, U.S. Pat. Nos. 1,268,914 and 1,275,168 include complicated centrifugally actuated braking governors which are not only expensive but which are also bulky and therefore unsightly, requiring a special housing at the end of the roller. U.S. Pat. Nos. 2,166,745 and 1,699,555 are directed to roller shades which lack the spring driven return mechanism and they, as well as 1,772,700, include braking devices which engage the roller from its exterior, thereby also producing an unsightly arrangement. As may be appreciated, all shade brake mechanisms external to the roller are undesirable since they are not suitable for mounting in the window opening itself but must be either mounted within the window frame or on that portion of the window frame facing into the room so that the roller shade projects into the room; an arrangement which may unsatisfactorily interfere with the interior decor of the room such as window curtains.

Of the remaining prior art U.S. Patents previously listed, U.S. Pat. No. 2,678,094 discloses an adjustable stop mechanism and a braking mechanism which is subject to accidental release and stuttering as the brake is engaging. U.S. Pat. No. 3,211,212 discloses a constantly applied brake which, once installed, is not accessible for subsequent adjustment as either the friction surfaces become polished or as the brake actuating springs become fatigued and less powerful.

SUMMARY OF THE INVENTION

These defects and others of the prior art roller shade braking devices are addressed and solved by the present invention which has no ratchet device and which includes an axially elongated roller shade barrel having an internally mounted motor at one end for urging the barrel to rotate in a shade winding direction and a window shade braking mechanism at the other end of the barrel of the type adapted to be internally mounted. The braking mechanism includes a hollow cylindrical brake drum in one end of the barrel with an internally disposed cylindrical braking device having first and second oppositely directed brake shoes. Each of the brake shoes has a cylindrical outside surface for frictional engagement with the interior surface of the brake drum. The brake shoes include opposed inwardly facing surfaces which form an axially inwardly tapering cavity which receives therewithin an axially inwardly tapering wedge. Axial adjustment of the position of the wedge urges the respective brake shoes outwardly into frictional contact with the brake drum. Means are provided for holding the brake shoes rotationally stationary relative to the rotation of the elongated barrel and one of the brake shoes includes a means for adjustably providing the axial positioning of the wedge.

In a preferred form, one of the brake shoes is formed to have an end member or flange which carries an axially, outwardly extending square spindle with a threaded bore therethrough adapted to receive therein a threaded adjustment screw. The position of the biasing wedge is determined by the axial position of the adjustment screw which is adjustable through a bore in the square spindle.

BRIEF DESCRIPTION OF THE DRAWINGS

The invention may be better understood and its numerous objects and advantages will become apparent to those skilled in the art by reference to the accompanying drawings wherein like reference numerals refer to like elements in the several figures and in which.

DESCRIPTION OF THE PREFERRED EMBODIMENT

Figure 1:
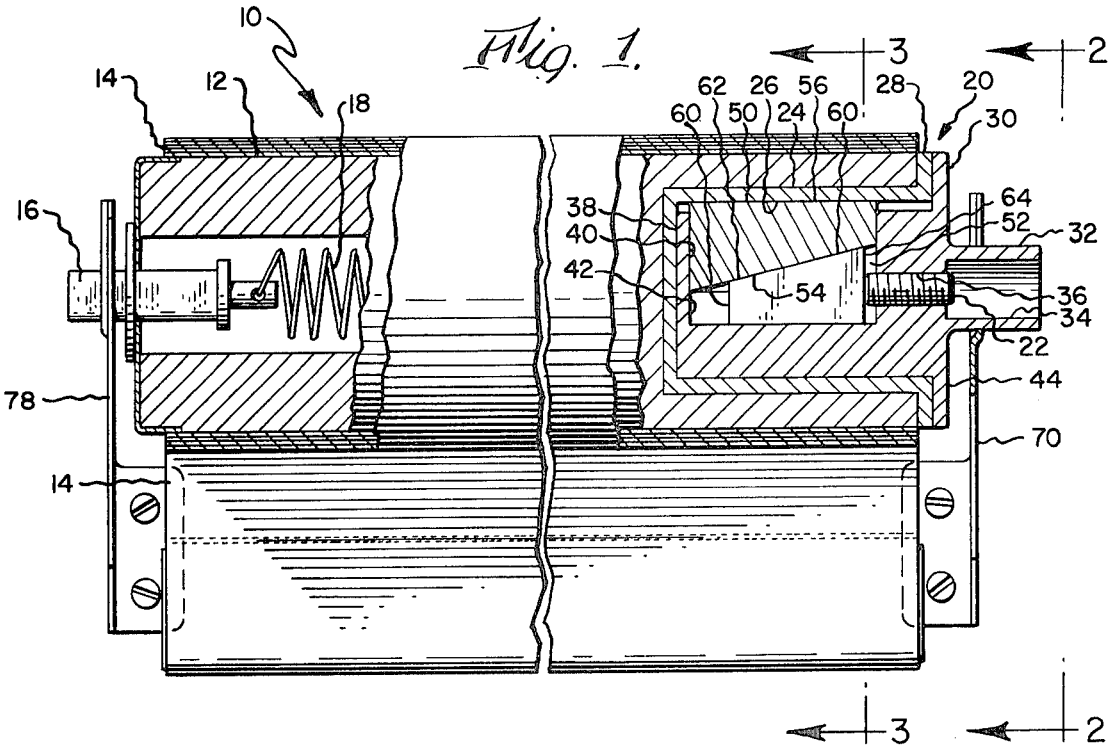
FIG. 1 illustrates a roller shade broken away in cross-section at both ends to show the driving motor and the braking mechanism respectively.

While the invention is susceptible of various modifications and alternative constructions, there is shown in the drawings and there will hereinafter be described, in detail, a description of the preferred embodiment of the invention. It is to be understood, however, that the specific description and drawings are not intended to limit the invention to the specific form disclosed. On the contrary, it is intended that the scope of this patent include all modifications and alternative constructions thereof falling within the spirit and scope of the invention as expressed in the appended claims to the full range of their equivalence.

In the present invention, a roller shade braking mechanism has been designed to provide the function of constantly applying a braking force which continuously resists both the winding and unwinding motions of the roller. Such a braking device is advantageous in that, when properly adjusted, the roller shade may be pulled down and returned to any desired position by the mere actions of pulling or lifting the unwound shade portion. Thus, the inconvenient simultaneous actions necessary in many prior art shades requiring the use of two hands to change the position of the shade are eliminated. Additionally, the jerking motion required for the release of the ratchet positioning mechanism of prior art roller shades is also eliminated.

In order to perform most satisfactorily, it is desirable that the roller shade of the present invention be designed so that the linearly increasing weight of the unwound portion of the shade approximately balances and therefore substantially cancels out the linearly increasing winding force provided by the rewinding spring motor. When this balance has been achieved by the proper selection of the torsional spring in the motor, a relatively minor braking force is required to maintain the unwound roller shade in any desired position. With this arrangement, movement of the shade in an up or down direction is easily accomplished by lifting up on or pulling down on the roller shade, thereby upsetting the balance of forces and overcoming the braking force constantly applied by the brake. However, as may readily be appreciated, if the downward force of the unwound portion of the roller shade and the upward force of the spring motor are not closely balanced, the desirable objective of halting the roller shade in any position may still be achieved by increasing the braking force applied by the brake which overcomes the imbalance.

As may be readily appreciated, the above concepts are applicable to any shade or partition device which is windably mounted on a roller which is continuously urged to rotate in its winding direction. Therefore, while the present invention is applicable to relatively light roller shades suitable for a homeowner's window, it is even more applicable to the wider roller shade used in commercial buildings as well as to the heavier roller shades such as bamboo or woven wood shades or room dividers.

Turning now to a description of the apparatus embodying the invention as shown in FIG. 1, the roller shade 10 is illustrated with broken away end sections showing the spring motor 18 at one end and the brake assembly 20 at the other end and is mounted in position by a pair of wall brackets 70 and 78. The roller shade 10 includes a roller 12 and a shade 14 would therearound. As will be well understood by those skilled in the art, spring 18 is fastened to the interior of roller 12 at one end and to a spindle 16 at its other end. Spindle 16 in turn is rotatably mounted in the end of the roller 12 for relative rotational movement and is held rotationally fixed by the appropriate end mounting bracket 78. In a common arrangement, spindle 16 includes two flat surfaces which are slidingly received within a rectangular slot formed by the mounting bracket 78.

At the opposite end of the roller shade 10 of FIG. 1, the structure of the braking mechanism 20 is shown as including a cup-like cylindrical brake drum 24 axially received within the end of roller 12. Brake drum 24 is rotationally fixed to roller 12 and includes an interior cylindrical surface 26 which provides the friction surface for the brake mechanism. In a preferred form, brake drum 24 has a radially extending end flange 28 whose diameter equals the diameter of roller 12.

Figure 4:
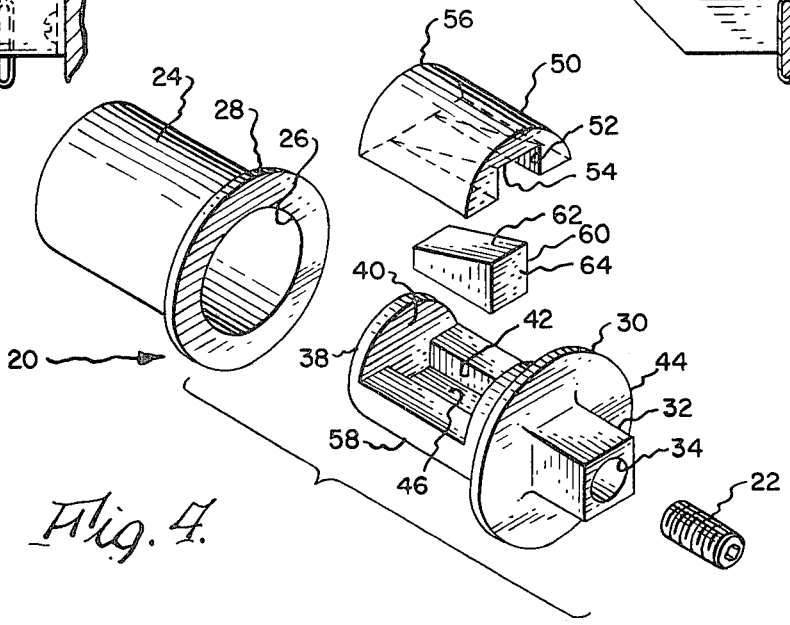
FIG. 4 is an exploded perspective view of the braking mechanism of FIG. 1.

Mounted within brake drum 24 are first and second brake shoes 30 and 50 which together have the appearance of a spool with a right circular cylindrical shape. Exterior cylindrical surfaces 58 and 56 respectively form the friction surfaces of the brake shoes. An outwardly extending circular flange 44 which has a maximum diameter equal to the diameter of roller 12 is formed at one end of brake shoe 30. As may best be seen in FIGS. 2 and 4, brake shoe 30 also includes an axially outwardly extending square spindle 32 which has a central axial bore 34 formed therewithin. Axial bore 34 communicates with a threaded axial bore 36 adapted to threadedly engage a screw 22. As may be seen, brake shoe 30 is formed to have a laterally extending recessed portion 40 and an interior end flange 38. This recessed portion 40 is formed to receive therewithin the second brake shoe 50 and cooperates to hold shoe 50 and shoe 30 rotationally fixed relative to one another.

Each of the brake shoes 30 and 50 have inwardly and opposite facing surfaces 46 and 54 respectively which are angled to form an axially inwardly tapering cavity 52 between the brake shoes when shoe 50 has been slidingly positioned within depression 40. Tapered cavity 52 is provided to receive therewithin an axially inwardly tapering brake wedge 60 which includes an inclined plane 62 and an end bearing surface 64. Recessed groove 42 within recessed portion 40 of brake shoe 30 functions as a means for receiving, positioning, and guiding the brake wedge 60. The axially exterior end of groove 42 communicates with the threaded bore 36 so that when threaded screw 22 is screwed in through the bore 36 it can be brought to bear against the bearing surface 64 of the wedge 60 in order to influence its axial position.

Since screw 22 is externally accessible through bore hole 34, the position of screws 22 and hence the position of braking wedge 60 may be externally adjusted. Accordingly, when assembled as shown in FIG. 1, the desired degree of braking force may be applied by the adjustment of screw 22. The axial inward movement of screw 22 brings about the axial inward movement of wedge 60 which is inserted deeper into the tapered cavity 52 thereby forcing brake shoes 30 and 50 apart to cause their cylindrical braking surfaces 56 and 58 to bear respectively on the interior friction surface 26 of brake drum 24.

Figure 2:
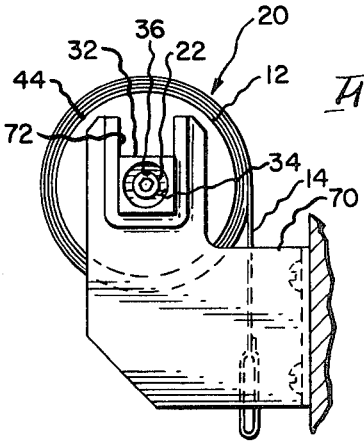
FIG. 2 is an end view of the roller shade taken along a line 2—2 of FIG. 1.
Figure 3:
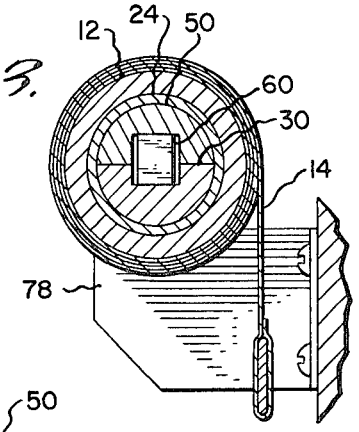
FIG. 3 is a cross-section of the roller shade taken along lines 3—3 of FIG. 2 and shows the cross-sectional details of a braking device.

As best seen in FIG. 2, the square end spindle 32 of brake shoe 30 is slidingly received in and supported by a rectangular slot 72 formed in mounting wall bracket 70. In this manner, brake shoe 30 is rotationally fixed relative to the wall and is rotationally moveable relative to the roller 12. As previously discussed, brake shoe 50 is prevented from rotating with the brake drum 24 by the interaction of the surfaces of both shoes 30 and 50. In addition, rotational movement of shoe 50 is prevented by the keying effect brought about by the insertion of wedge 60 in mating grooves 42 and 52.

While a preferred embodiment has been disclosed, it is apparent that many variations and modifications of the invention are possible without deviating from the scope of the invention. For example, one such variation would be the formation of a conical cavity 52 with a conical "wedge" member 60. Another possible and perhaps desirable modification might be the formation of the "wedge" member 60 as an integral part of screw 22 at its innermost end.

What is claimed is:

1. An improved roller shade of the type having an axially elongated barrel adapted to receive a shade wound therearound, said elongated barrel having an internally mounted motor for urging said barrel to rotate in a shade winding direction, said barrel further including an internally mounted braking mechanism for resisting rotation of said barrel, said braking mechanism comprising a hollow brake drum with an internally disposed braking mechanism having first and second oppositely directed brake shoes, said brake shoes each having an outside surface adapted for frictional engagement with the interior surface of said brake drum, wherein the improvement comprising:

(a.) said first and second brake shoes having opposed inwardly facing surfaces forming an axially tapering cavity;

(b.) an axially moveable means adapted to be inserted in said cavity and adapted to engage said opposed inwardly facing surfaces for causing said first and second brake shoes to be urged laterally outwardly proportional to the axial position of said axially moveable means; and (c.) means operatively engaging said axially moveable means for axially and adjustably positioning said axially moveable means.

2. The improved roller shade as recited in claim 1 wherein said axially moveable means includes an axially tapering wedge-like member.

3. The improved roller shade as recited in claim 1 further including means connected to one of said brake shoes for holding said brake shoes rotationally stationary.

4. The improved roller shade as recited in claim 2 wherein said means for axially and adjustably positioning said wedge like member includes a threaded screw like means whose position may be axially moved by rotation of said screw like means.

5. The improved roller shade as recited in claim 3 wherein said means connected to one of said brake shoes for holding said brake shoes rotationally stationary includes an axially outwardly extending spindle fixed to said one brake shoe and adapted to be engaged and held rotationally stationary by a wall bracket.

6. The improved roller shade as recited in claim 5 wherein said axially moveable means includes an axially tapering wedge like member and wherein said means for axially and adjustably positioning said wedge like member includes a threaded screw like means whose position may be axially moved by rotation of said screw like means.

7. The improved roller shade as recited in claim 6 wherein said one brake shoe includes an axially threaded bore for receiving in threaded engagement therewithin said threaded screw like means.

8. The improved roller shade as recited in claim 6 wherein said one brake shoe comprises a right circular cylinder having a radially extending circumferential flange at one end thereof, said one brake shoe having a laterally extending recessed portion adapted to receive therein the other of said first and second brake shoes, said recessed portion having an axially extending groove therein adapted to receive and slidingly guide said wedge like member, said groove communicating with said axially threaded bore.

9. The roller shade as recited in claim 1 wherein said motor is of the type which produces a shade winding force which is directly and linearly proportional to the degree of unwinding rotation of said elongated barrel and wherein said shade winding force produced by said motor is substantially equal to the shade unwinding force produced by the weight of the unwound portion of said shade over all unwound positions of said shade.

* * * * *